US010368630B2

(12) United States Patent
Jones

(10) Patent No.: US 10,368,630 B2
(45) Date of Patent: Aug. 6, 2019

(54) ADJUSTABLE COSMETIC BRUSH SYSTEM

(71) Applicant: SI/TKO Holdings, Inc., Odessa, FL (US)

(72) Inventor: Ryan Christopher Jones, Dunedin, FL (US)

(73) Assignee: SI/TKO Holdings, Inc., Odessa, FL (US)

( * ) Notice: Subject to any disclaimer, the term of this patent is extended or adjusted under 35 U.S.C. 154(b) by 233 days.

(21) Appl. No.: 15/423,182

(22) Filed: Feb. 2, 2017

(65) Prior Publication Data

US 2017/0224098 A1 Aug. 10, 2017

Related U.S. Application Data

(60) Provisional application No. 62/291,611, filed on Feb. 5, 2016.

(51) Int. Cl.

| | |
|---|---|
| ***A46B 9/10*** | (2006.01) |
| ***A46B 9/02*** | (2006.01) |
| ***A46B 13/02*** | (2006.01) |

(52) U.S. Cl.

CPC ..... *A46B 9/10* (2013.01); *A46B 9/021* (2013.01); *A46B 13/023* (2013.01)

(58) Field of Classification Search

CPC ..... A46B 9/10; A46B 9/021; A46B 13/023

USPC ..... 15/169

See application file for complete search history.

(56) References Cited

U.S. PATENT DOCUMENTS

| | | | | | |
|---|---|---|---|---|---|
| 1,321,907 | A * | 11/1919 | Graham | B43K 7/12 | 15/169 |
| 1,322,641 | A * | 11/1919 | Stanley | A46B 17/06 | 15/169 |
| 1,355,026 | A * | 10/1920 | Austin | A46B 11/0013 | 15/169 |
| 1,563,031 | A * | 11/1925 | Jones | A46B 9/08 | 15/169 |
| 1,749,052 | A * | 3/1930 | Denby | A46B 15/00 | 15/184 |
| 3,205,523 | A * | 9/1965 | Seaver | A46B 7/023 | 15/169 |
| 3,309,728 | A * | 3/1967 | Seaver | A46B 7/023 | 15/184 |
| 4,248,543 | A * | 2/1981 | Carrington | A46B 9/10 | 401/183 |

(Continued)

FOREIGN PATENT DOCUMENTS

WO WO-2013077284 A1 * 5/2013 ..... A46B 13/02

*Primary Examiner* — Weilun Lo

(74) *Attorney, Agent, or Firm* — Paul Murty; Smith & Hopen, P.A.

(57) ABSTRACT

A handle shaft has an upper end and a lower end. A cylindrical collar extends upwardly from the upper end of the handle shaft. The cylindrical collar has an open top. A brush head is formed of a plurality of elongated bristle fibers. The bristle fibers have lower ends secured in the open top of the cylindrical collar. The bristle fibers have free upper ends and a middle section. A ferrule assembly is axially reciprocable upon the cylindrical collar between a cleaning lower position and a raised position for cosmetic product application. The ferrule assembly is in sliding contact with the cylindrical collar. The ferrule assembly has a lower end and an upper end. The upper end is of a reduced circumference for sliding contact with the bristle fibers.

1 Claim, 5 Drawing Sheets

(56) References Cited

U.S. PATENT DOCUMENTS

| | | | | |
|---|---|---|---|---|
| 5,339,483 | A * | 8/1994 | Byun | A45D 40/10 132/313 |
| 9,808,076 | B1 * | 11/2017 | DeVito | A46B 9/021 |
| 2005/0273962 | A1 * | 12/2005 | Dillon | A46B 9/10 15/169 |
| 2013/0121752 | A1 * | 5/2013 | Byun | A45D 33/36 401/269 |
| 2014/0331429 | A1 * | 11/2014 | Lim | A45D 40/262 15/190 |
| 2015/0296965 | A1 * | 10/2015 | Peskin | A46B 9/021 15/171 |
| 2016/0250457 | A1 * | 9/2016 | Bock | A61M 37/0092 604/22 |

* cited by examiner

FIG. 1
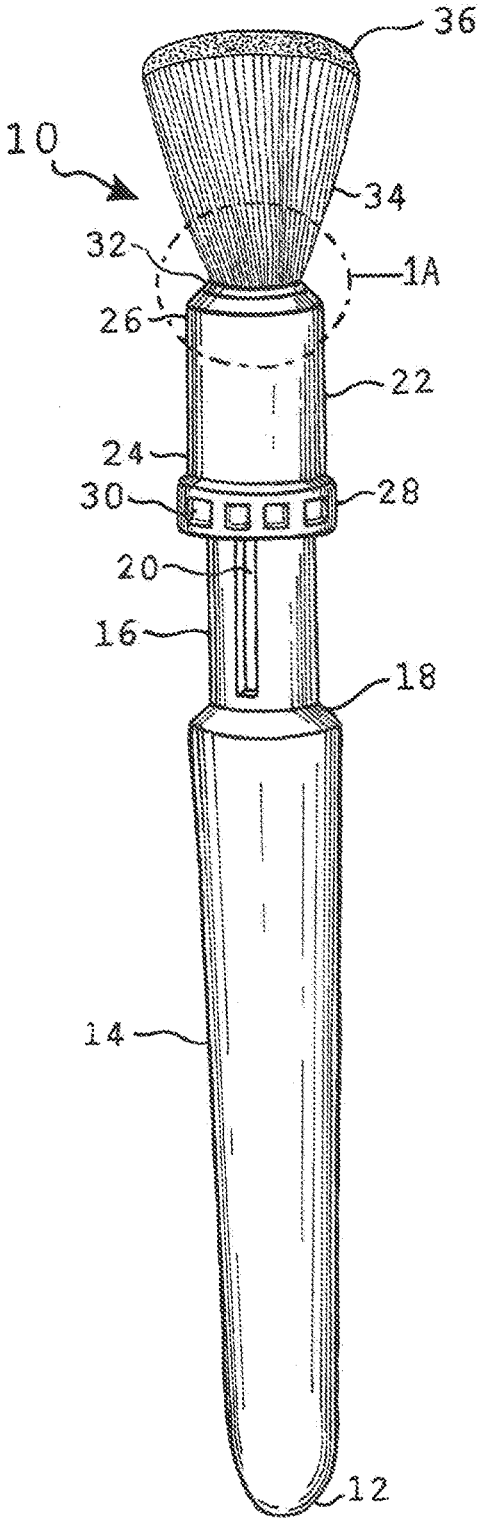
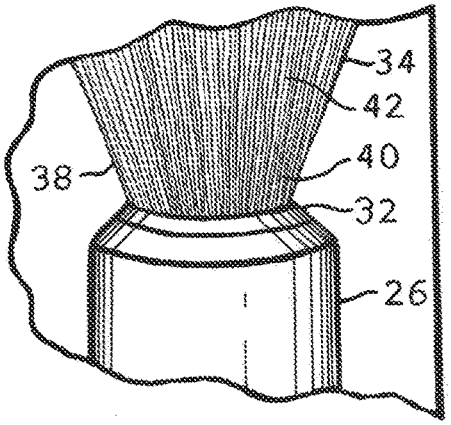
FIG. 1A

ADJUSTABLE COSMETIC BRUSH SYSTEM

RELATED APPLICATION

This application is based upon and claims the benefit of Provisional Application No. 62/291,611 filed Feb. 5, 2016, entitled "Adjustable Cosmetic Application Brush System," the subject matter of which application is incorporated herein by reference.

BACKGROUND OF THE INVENTION

Field of the Invention

The present invention relates to an adjustable cosmetic brush system and more particularly pertains to incorporating an adjustable ferrule assembly which rotates laterally to adjust the brush head contour shape and telescopes vertically along a brush handle collar formed with an upper recessed opening to fasten an elongated plurality of bristles to provide the services of effectively cleaning the constricted heal areas within a tuft of bristles exiting the brush ferrule where cosmetic makeup, dirt, oil and other contaminates build up while a lower chamber incorporated within the brush handle shaft contains an electrical rechargeable battery source and a rotary motor with a shaft equipped with an offset weight and a heating coil and power switch to activate the system to incorporate vibrations and or heat to the tuft of bristle fibers which further increases the brush systems cosmetic product application efficiencies.

Description of the Prior Art

Cosmetic products are often applied to the face, head or body by a brush or other implements. The use of cosmetic application brushes providing a plurality of bristles fastened within a stationary ferrule that extend outward for cosmetic practices is known in the prior art that vary in shape and size. More specifically, cosmetic application brushes previously devised and utilized for the purpose of providing a plurality of bristles fastened within a retractable ferrule to alter the length of bristles extending outward for cosmetic product applications and protecting bristles for storage are known to consist basically of familiar, expected, and obvious structural configurations, notwithstanding the myriad of designs encompassed by the crowded prior art which has been developed for the fulfillment of countless objectives and requirements.

While the cosmetic brushes known in the prior art fulfill their respective, particular objectives and requirements, to form the brush head shape intended for cosmetic application practices these brushes having ferrules in stationary and various height positions clutch the tuft of fastened bristles extending outward from the ferrule tightly which constricts the plurality of bristles in the brush heal area nearest the ferrule making regular maintenance routines difficult to effectively clean and remove cosmetics, dirt, oil and other unwanted contaminates that build up in these restricted bristle areas nearest the ferrule in the brush heal.

In this respect, the adjustable cosmetic brush system according to the present invention substantially departs from the conventional concepts and designs of the prior art, and in doing so provides an apparatus primarily developed for the purpose of incorporating an adjustable ferrule assembly into a cosmetic brush handle having an interior chamber and upper cavity for fastening an elongated tuft of bristles within the ferrule assembly that when fully retracted exposes greater lengths of the tuft which temporarily releases the tension needed to form the brush head shape for application practices however allows access to effectively maintain and clean brush heal areas of tightly held constricted bristle fibers nearest the ferrule in application positions and while the handle interior chamber contains a mechanism to add vibrations and heat to the tuft of bristles to increase the brush systems abilities to accomplish the intended cosmetic application practices, the incorporating being done in a safe, convenient, simple and economical manner.

Therefore, it can be appreciated that there exists a continuing need in the art for a new and improved adjustable cosmetic brush system that provides abilities to access and effectively clean restricted bristle fibers in brush heal areas nearest the ferrule while also incorporating additional brush application features to improve the brush capabilities to effectively apply cosmetic products, the incorporating being done in a safe, convenient, simple, and economical manner. In this regard, the present invention substantially fulfills this need.

SUMMARY OF THE INVENTION

In view of the disadvantages inherent in the known types of cosmetic application brushes now present in the prior art, the present invention provides an improved adjustable cosmetic brush system with a chambered handle and ferrule assembly that rotates laterally to adjust tension clutching the elongated tuft of bristles and telescopes vertically along the chambered handle collar from the uppermost position intended for practical applications of cosmetic products to the lowermost cleaning position not intended for application purposes exposing a greater length of bristle fibers contained within the ferrule assembly which releases constricted heal area tensions forming the brush head shape allowing the capabilities to effectively clean and remove cosmetic makeup, dirt, oil and contaminants that buildup in restricted brush heal areas of bristles exiting a brush ferrule for the application of cosmetic products.

As such, the general purpose of the present invention, which will be described subsequently in greater detail, is to provide a new and improved adjustable cosmetic brush system and method which has all the advantages of the prior art and none of the disadvantages.

To attain this, the adjustable cosmetic brush system is comprised of a plurality of components. In their broadest context such include a chambered brush handle formed to fasten an elongated plurality of bristles with an adjustable ferrule that travels along the handle collar to release tension on constricted bristle areas that form the brush head shape for cleaning capabilities to remove cosmetic products and contaminants from tight brush heal areas. Such components are individually configured and correlated with respect to each other so as to attain the desired objective.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved adjustable cosmetic brush system which has all the advantages of the prior art cosmetic brush systems and none of the disadvantages.

It is another object of the present invention to provide a new and improved adjustable cosmetic brush system which may be easily and efficiently manufactured and marketed.

It is a further object of the present invention to provide a new and improved adjustable cosmetic brush system which is of durable and reliable constructions.

An even further object of the present invention is to provide a new and improved adjustable cosmetic brush system which is susceptible of a low cost of manufacture with regard to both materials and labor, and which accordingly is then susceptible of low prices of sale to the consuming public, thereby making such adjustable cosmetic brush system economically available to the buying public.

Lastly, it is an object of the present invention to provide an adjustable cosmetic brush system for incorporating a chambered handle into an adjustable ferrule system for maintenance to an elongated tuft of bristles, the incorporating being done in a safe, convenient, simple, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings of primary and alternate embodiments of the invention wherein:

FIG. 1 is a front perspective illustration of the adjustable cosmetic brush system assembly constructed in accordance with the principles of the present invention.

FIG. 1A is an enlarged illustration designated by the letter A identifying the tight brush heal area of constricted bristles exiting a brush ferrule for cosmetics application practices.

The same reference numerals refer to the same parts throughout the various Figures.

DESCRIPTION OF THE PREFERRED EMBODIMENT

Figure 2:
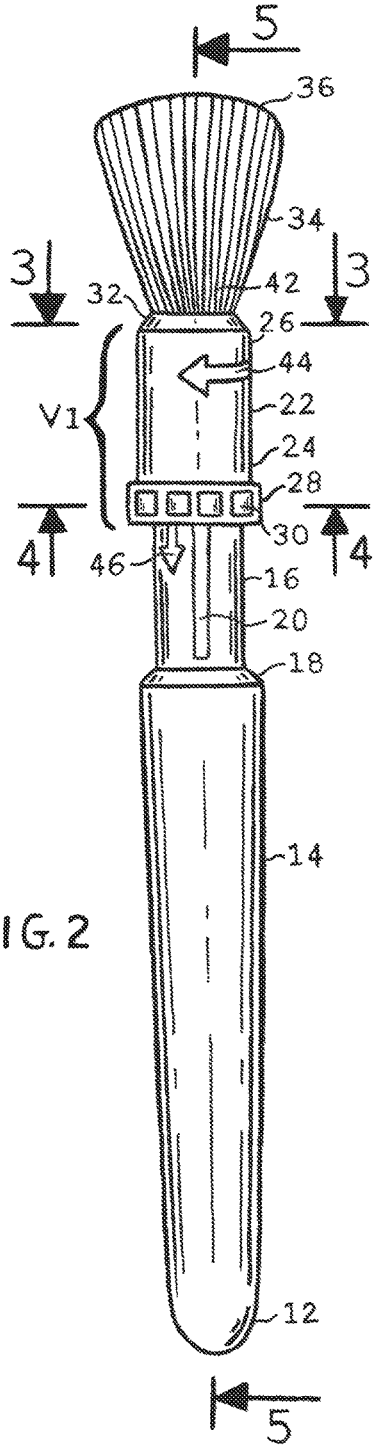
FIG. 2 is a front view of the adjustable cosmetic brush system with the vertically telescoping ferrule assembly fully extended to its cosmetic application position.

With reference now to the drawings, and in particular to FIG. 1 thereof, the preferred embodiment of the new and improved adjustable cosmetic brush system embodying the principles and concepts of the present invention and generally designated by the reference numeral 10 will be described.

The present invention, the adjustable cosmetic brush system 10 is comprised of a plurality of components. Such components in their broadest context include a chambered brush handle, an adjustable ferrule and an elongated tuft of bristles. Such components are individually configured and correlated with respect to each other so as to attain the desired objective.

From a specific standpoint, in the preferred embodiment of the invention, first provided is a cosmetic brush handle. A cosmetic brush handle has an outer cylindrical shaft varying in diameter and length made of hard material that is formed with an interior chamber area. The cosmetic brush handle also has an upper collar with opposing vertical channels and an upper perpendicular cavity approximately one quarter to one half inch in depth recessed into the top of the cylindrical collar which is approximately one and one half inches in length and varies in diameter with respect to the predetermined shaft length and diameter.

Next is a cosmetic brush ferrule assembly. The cylindrical ferrule assembly is formed by outer and inner ferrule couplers each having upper and lower openings. The outer coupler rotates laterally around the inner coupler and both have correlating channels to guide lateral movements. The outer coupler has an upper oval shaped opening opposite of the inner couplers upper oval shaped opening. Rotating the ferrule outer section clockwise and counterclockwise around the inner coupler increases or decreases the combined ferrule assembly uppermost opening surface area or diameter clutching the tuft of bristle fibers. The ferrule inner section has curved inside walls with small aligning tabs protruding towards the center of the ferrule assembly for telescoping along the vertical handle collar channels. When the ferrule assembly outer and inner coupler upper oval shaped openings are aligned the inner coupler can be telescoped vertically along the brush handle collar channels.

Lastly provided is a plurality of bristle fibers made of various materials, lengths, thicknesses and rigidness. Extended lengths of bristle fibers are selected to form upper, lower and middle sections when bundled into various diameter tufts for a range of cosmetic application purposes which correspond with the brush handle specifications. The tufts are aligned by the lower section ends and secured with a bonding adhesive and a round clasp. The lower section secured end is then fixed into the brush handle collar top recessed opening. The bristles opposing upper section loose end is fed through the ferrule assembly lower then upper opening to extend outward to form the cosmetic application brush head. The middle section formed by the elongated bristles remains enclosed within the ferrule assembly while fully extended for application practices. Only when the ferrule is retracted to the lowest cleaning position is the middle section extended from the ferrule system opening to access constricted brush heal areas in the upper section.

FIGS. 1-9 illustrate the preferred embodiment of the adjustable cosmetic brush system, designated by reference numeral 10. The adjustable cosmetic brush system 10 is for adjusting the ferrule assembly tension clutching the elongated plurality of bristles protruding outward from the dual coupler ferrule upper oval shaped openings while vertically telescoping positions along the chambered handle collar to increase effectiveness of the system to allow cleaning constricted bristles in brush heal areas and modifying the application contour shape of the grouping of bristles in the extended vertical application position.

The front region of the brush assembly has a configured handle with a lowermost handle base 12 and a vertical shaft 14 which has a tapered thickness and varies in total length and diameter. The upper handle shaft section has a cylindrical collar 16 that has a diameter slightly less than the handle shaft. Approximately one fifth up the length of the handle shaft 14 is a collar base 18 with a small radius ledge that transitions the handle shaft and collar sections. The handle collar has opposing vertical channels 20 that extend upwards from the collar base 18.

Mounted to the handle collar assembly is an adjustable ferrule assembly 22. The ferrule assembly has a lower section 24 and an upper section 26. The ferrule assembly lower section 24 has a thicker diameter ferrule adjustment 28 molded into the ferrule assembly outer casing. The adjustment has recessed notches 30 encompassing the diameter for gripping purposes. The ferrule assembly upper section 26 has an uppermost opening 32 for which a plurality of bristle fibers 34 extend outward from the opening. The upper section of the tuft or plurality of bristle fiber tips are arranged in predetermined lengths aligned at the opposing lower section ends connected by the tuft middle section to form the application brush head 36. The purpose of the upper, middle and lower tuft sections is further explained in FIG. 7 and FIG. 8. FIG. 1A shows an exploded view of the ferrule assembly upper section 26 and uppermost opening 32 identified by letter A. The area bristles exit a brush nearest the ferrule is commonly referred to as the brush heal 38. Bristles in this region closest to the ferrule assembly are held tightly by clutch tension 40 from fastening the tuft of bristles lower section within the ferrule. Cosmetic brushes are routinely cleaned to remove cosmetic material, dirt, oil and other contaminants that accumulate in this constrained area 42 which is difficult to access while cleaning due to the tightly held bristle formation required shape the brush head for cosmetic application purposes.

FIG. 2 shows a front view of the adjustable cosmetic brush system ferrule assembly in the fully extended application position designated as V1. The ferrule assembly 22 can be rotated laterally approximately one quarter the brush collar diameter in a clockwise direction (Curved Arrow 44). Referencing FIG. 3, FIG. 4 and FIG. 6, when the two ferrule assembly oval shaped openings are aligned parallel to one another (designated as L2 in FIG. 6) the ferrule assembly 22 can be retracted vertically to the lowest cleaning position (Arrow 46) along the collar channels 20.

Figure 3:
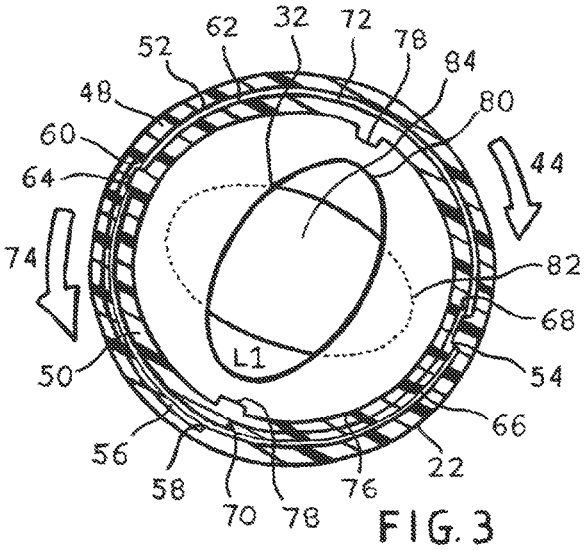
FIG. 3 is a cross sectional view of the adjustable cosmetic brush system ferrule assembly taken along line 3-3 of FIG. 2 illustrating the ferrule assembly adjusted to clutch the plurality of bristles for cosmetic application purposes.

Next, FIG. 3 illustrates an upper cross sectional view of the adjustable cosmetic brush system ferrule assembly internal components taken along line 3-3 of FIG. 2. The ferrule assembly 22 encompasses an outer coupler 48 that is affixed to the inner coupler 50. The outer coupler 48 has an interior curved wall 52 that has a rotation guide tab 54. The outer coupler also has a lateral rotation guide channel 56 which has a clockwise stop 58 and a counterclockwise stop 60. The inner coupler has an outer curved wall 62 with a comparable rotation guide tab 64 that travels back and forth within the outer coupler channel 56. The inner couplers outer curved wall 62 also has a comparable lateral rotation guide channel 66 with a counter clockwise stop 68 and a clockwise stop 70 for which the outer coupler rotating guiding tab 54 travels back and forth within the inner coupler guide channel 66. Between the outer coupler and inner coupler is a small clearance gap 72 that allows the outer coupler to rotate laterally by twisting the ferrule adjustment 28 in a clockwise motion (Curved Arrow 44) and counter clockwise motion (Curved Arrow 74). The inner coupler 50 has an interior curved wall 76 which has opposing vertical guide tabs 78 that travel vertically within the handle collar channels 20. The outer coupler has an uppermost oval shaped opening 80 and the inner coupler has a comparable oval shaped opening 82. The oval shaped openings alignment to one another increases or decreases the ferrule assembly uppermost opening diameter 84 which alters clutch tension 40 applied to the plurality of bristles fibers 34.

Figure 4:
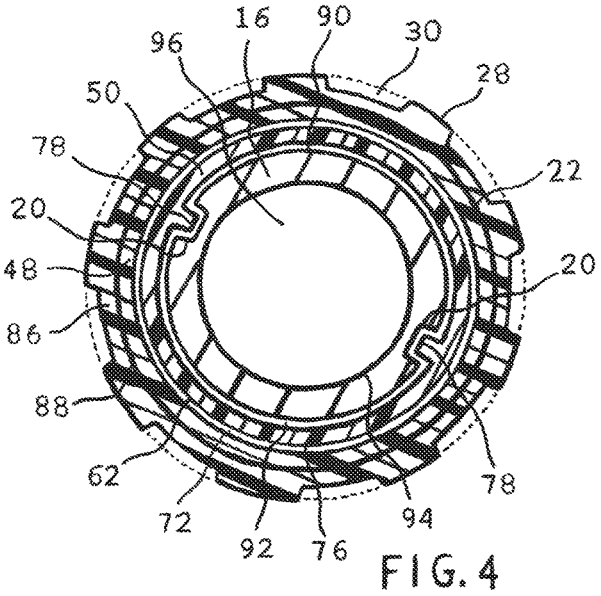
FIG. 4 is a cross sectional view of the adjustable cosmetic brush system ferrule assembly taken along line 4-4 of FIG. 2 illustrating the ferrule assembly couplers aligned for vertical telescoping adjustments along the brush handle collar.

Referencing FIG. 4, the inner coupler vertical guide tabs 78 are fastened to the handle collar vertical channels 20 that precludes inner coupler lateral rotation. In FIG. 3 the outer coupler 48 is shown in the furthest counter clockwise position within the ferrule assembly lateral rotation guide channels designated as L1. The outer coupler opening 80 is positioned approximately 90 degrees from parallel alignment with the inner coupler opening 82 in this designated L1 position. Now referencing FIG. 2 and FIG. 6, the outer coupler 48 can be rotated laterally in a clockwise direction (Curved Arrow 44) around the fastened inner coupler 50. The furthest clockwise travel rotation allowed within the coupler channels is when the inner and outer coupler vertical guide tabs reach the inner and outer coupler channel stops. In this position designated as L2 the outer coupler opening 80 is aligned parallel to the inner coupler opening 82. The purpose of the L1 and the L2 ferrule assembly lateral positions is further explained in FIG. 5 and FIG. 6.

Next, FIG. 4 illustrates an upper cross sectional view of the adjustable cosmetic brush system ferrule assembly internal components taken along line 4-4 of FIG. 2. First shown is the lower ferrule adjustment 28 and adjustment notches 30 have a perpendicular upper ledge 86 that encompasses the outer coupler 48 external curved wall 88. Next referencing handle collar 16 which has an exterior cylindrical wall 90 and opposing vertical channels 20 intended to guide the inner couplers opposing vertical guide tabs 80 while vertically telescoping the ferrule assembly 22. There is a small gap 92 between the handle collar exterior wall 90 and inner couplers interior wall 76 to allow clearance for the ferrule assembly to telescope vertically along the handle collar 16. The collar 16 also has an interior cylindrical wall 94 which the area between the collar interior walls 96 is where the lower section secured end of the bristle tuft is fastened to the brush handle (further shown in FIG. 8 and FIG. 9).

Figure 5:
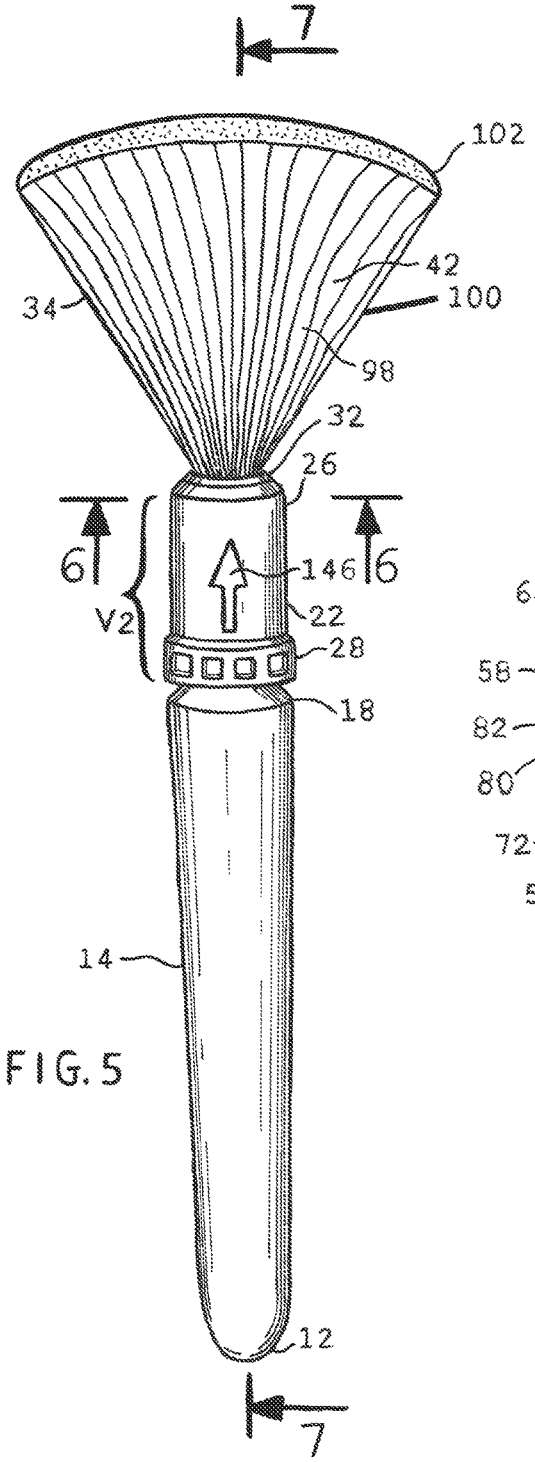
FIG. 5 is a front perspective illustration of the adjustable cosmetic brush system with the ferrule assembly adjusted to its lowest position for cleaning the constricted bristles in brush heal areas identified in FIG. 1A.

Now referencing FIG. 5, the perspective illustration shows the adjustable cosmetic brush system ferrule assembly 22 telescoped and retracted to the lowest cleaning position designated as V2 which exposes the lengthened bristles within the tuft middle section 98. While the ferrule assembly was in extended application use position V1 the brush heal 38 was located at reference point 100. Telescoping the ferrule assembly to the lowest cleaning position V2 releases the clutch tension 40 from bristles in the constricted area 42 creating a non-application brush head 102 preventing the plurality of bristles 34 from functioning as intended to apply cosmetic products which allows effectively cleaning and removing unwanted debris and contaminants that accumulate in the constrained areas of the brush heal 38 shown in FIG. 1A. Once cleaning practices are completed, the ferrule assembly 22 can be extended upward (Arrow 146) back to the fully extended application position V1 which returns the needed clutch tension 40 to the tuft middle section 98 to once again form the application brush head 36 and repositions the ferrule assembly 22 for alignment to rotate counter clockwise back to position L1 to adjust the desired application brush head contour for intended and effective cosmetic application purposes.

Figure 6:
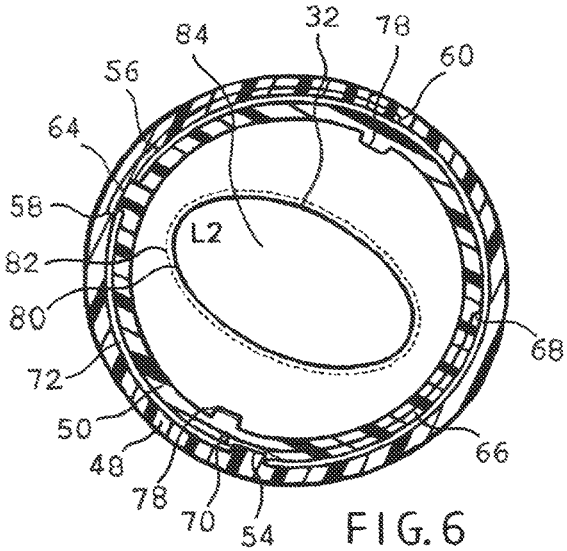
FIG. 6 is a cross sectional view of the adjustable cosmetic brush system taken along line 6-6 of FIG. 5 illustrating the ferrule assembly adjusted laterally to decrease clutch tension applied to the plurality of bristles.

Next, FIG. 6 illustrates an upper cross sectional view of the adjustable cosmetic brush system internal ferrule assembly components taken along line 6-6 of FIG. 5. The ferrule assembly is positioned in the clockwise position designated as L2 with the outer coupler opening 80 aligned parallel with the inner coupler opening 82 allows the ferrule assembly to vertically telescope between designated position V1 and position V2. Also referencing FIG. 3 with the ferrule assembly in the extended application position V1 and rotated to lateral position L1. First laterally rotating the ferrule assembly between position L2 and position L1 increases or decreases the uppermost opening diameter 84. From lateral position L2 the ferrule assembly 22 can be rotated counter clockwise (Curved Arrow 74) from designated position L2 to designated position L1. The surface area or uppermost opening diameter 84 is gradually reduced as the ferrule assembly 22 gets closer to designated position L1 therefore increasing the ferrule assembly clutch tension 40 applied to the plurality of bristles 34 which adjust the formed brush head contour for improving cosmetic application purposes (further shown in FIG. 8).

Figure 7:
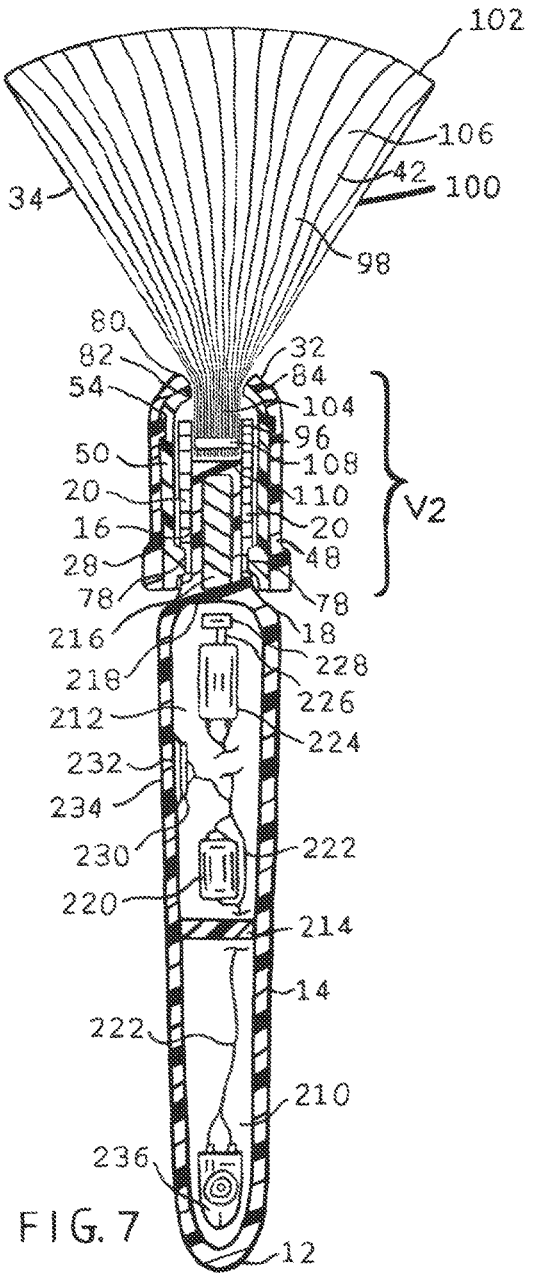
FIG. 7 is a longitudinal sectional view of the adjustable cosmetic brush system taken along line 7-7 of FIG. 5, illustrating the ferrule assembly retracted to its lowest position for cleaning constricted brush heal areas identified in FIG. 1A and shows the elongated tuft of bristles and the interior handle chambers with the vibration system.

Next FIG. 7 is a front cross sectional assembled view of the present invention taken along lines 7-7 of FIG. 5. To explain how the adjustable cosmetic brush system internal apparatuses achieves the designated L2 and V2 positions. First the outer coupler 48 rotation guide tab 54 travels clockwise within the inner coupler 50 rotation guide channel 66 as the ferrule assembly 22 is rotated to designated position L2 which aligns the outer coupler oval opening 80 and inner coupler oval opening 82 so the ferrule assembly 22 can now move along the tuft middle section 98. Next the inner coupler 50 vertical guide tabs 78 travel within the collar channels 20 as the ferrule assembly 22 telescopes and descends vertically to the lowest cleaning position designated as V2 where the ferrule adjustment 28 stops at the collar base 18. In this cleaning position the uppermost opening 32 holding the plurality of bristles is moved to the tuft lower section 104 creating the non-application brush head 102 from exposing the increased length of bristles in the tuft middle section 98 however this position allows effectively cleaning contaminants from the tuft upper section 106 and buildup area 42 where the ferrule assembly application position began identified by number 100. Next the ends of the tuft lower section 104 are secured by adhesive and a clasp 108 and then affixed to the perpendicular collar floor 110 within the collar interior walls 96 approximately one half inch in depth from the top of the collar.

Next, FIG. 7 shows and explains additional internal components of the present invention. The handle shaft 14 has front and rear exterior walls that form a lower interior chamber 210 and a middle interior chamber 212 separated by a lower interior wall 214 and an upper chamber 216 is formed within the collar 16 that is separated from the middle interior chamber 212 by an upper interior wall 218. Secured inside the middle chamber 212 is a rechargeable battery 220 connected to electrical wiring 222 that supply power to a small motor 224 that has a shaft 226 affixed with a counterbalance weight 228. Operating the motor 224 cause vibrations to be sent through the handle shaft 14 and through the collar floor 110 and through the plurality of bristles 34 to the brush head 36 to vibrate the bristle fibers which increases the brush systems efficiencies during cosmetic product application. The motor 224 is turned on and off by a sensor 230 that is mounted to the interior chamber wall 232 that can be activated with pressure placed to the outside of the interior chamber wall 234. Secured inside the lower interior chamber 210 is an inductive coupling receiver 236 for wireless battery charging when coupled to a compatible charging device.

Figure 8:
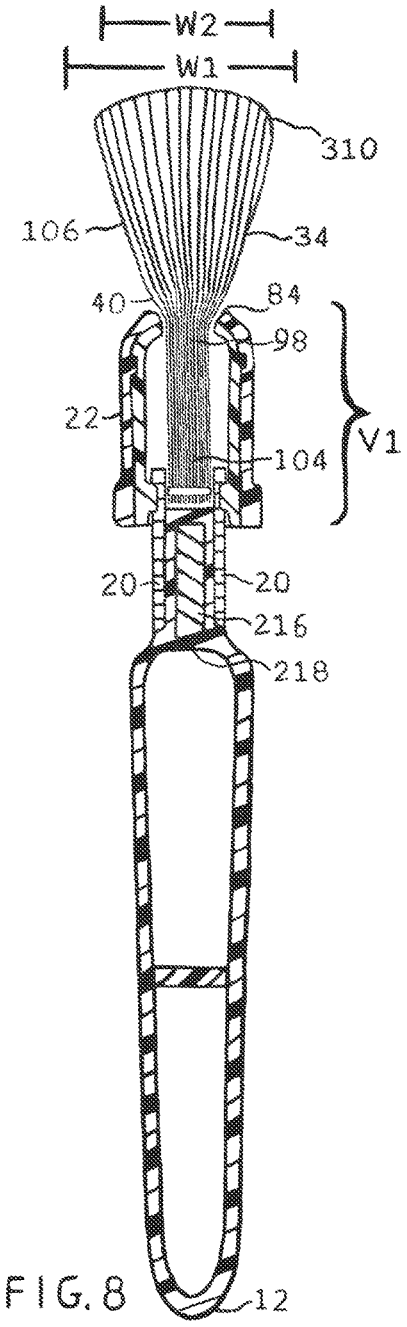
FIG. 8 is a cross sectional view of the adjustable cosmetic brush system taken along line 5-5 of FIG. 2 illustrating the ferrule assembly clutch tension impacts to the elongated bristles contoured shape for adjusting application purposes.

Next, FIG. 8 is a front cross sectional assembled view of the present invention taken along lines 5-5 of FIG. 2. When the ferrule assembly is in designated position V1 the brush system can be operated for cosmetic application while in position L1 or L2 depending on the individuals preference. The ability to adjust the uppermost opening diameter 84 and the clutch tension 40 allows changes to the brush head contour shape 310. During cosmetic application practices the individual can select between wider or a narrower application brush head 36 by changing between designated positions L1 and L2. The ferrule assembly 22 shown in FIG. 8 is in designated position L2 which forms a wider brush head contour designated as W1. The ferrule assembly 22 can be adjusted to designated position L1 which decreases uppermost opening 84 will cause a narrower brush head contour to form designated as W2. Either lateral ferrule assembly position allows cosmetic application practices to be performed effectively.

Figure 9:
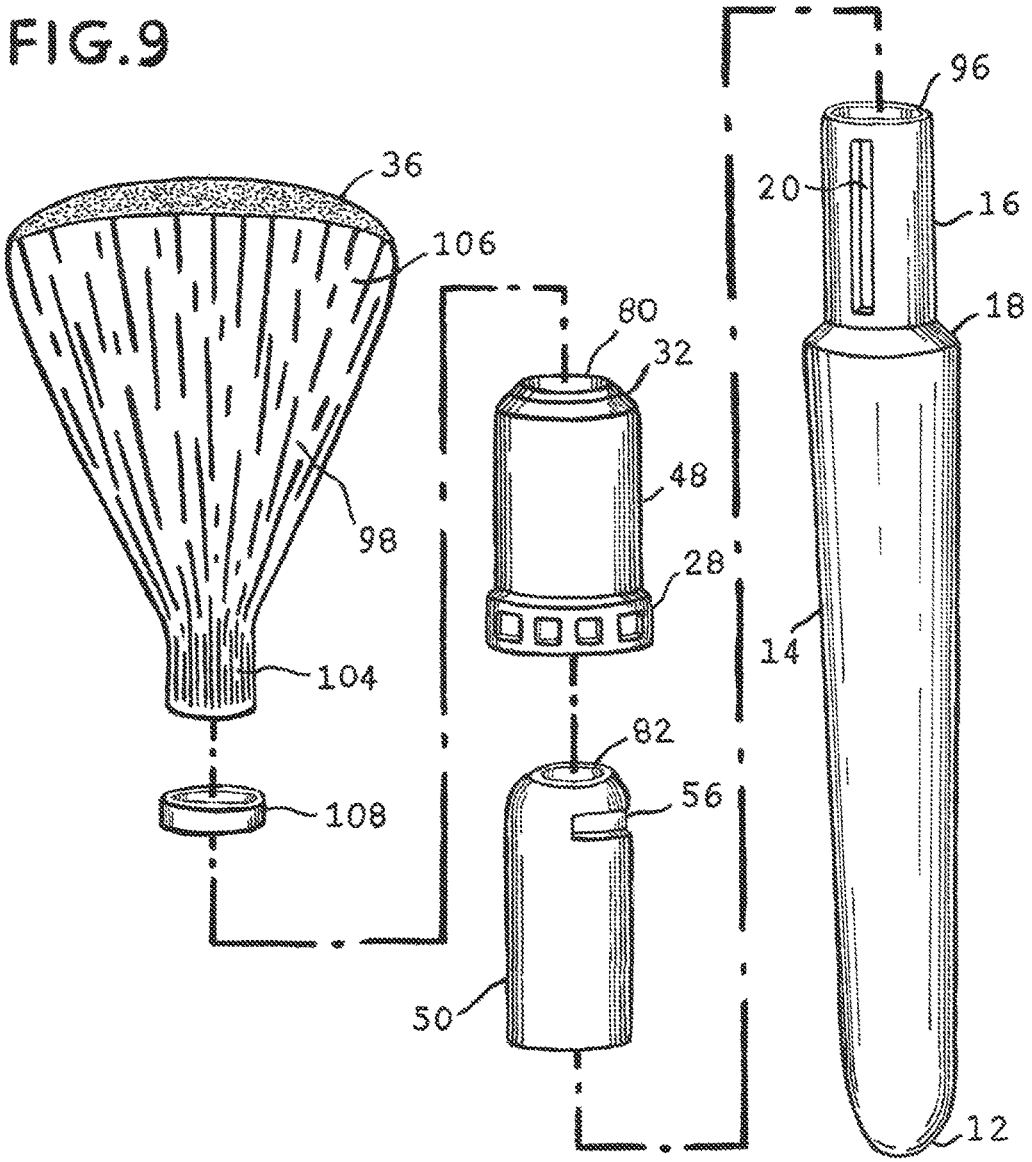
FIG. 9 is an exploded perspective view illustrating an example of the adjustable cosmetic brush system according to the present invention.

Lastly, FIG. 9 is an exploded perspective view of the adjustable cosmetic application brush system. The application brush head 36 is formed by a plurality of bristles 34 bundled into an elongated tuft having an upper section 106 a lower section 104 and a middle section 98 which are secured at the lower section ends by adhesive and a clasp 108 that is then passed through the upper oval shaped opening 80 of the outer coupler 48 and then passed through the upper oval shaped opening 82 of the inner coupler 50 and then the bundle is affixed between the collar interior walls 96 and the ferrule assembly is attached to the handle collar 16 and collar channels 20.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable cosmetic brush system (10) comprising, in combination:

a handle shaft (14) with an upper end and a lower end, a cylindrical collar (16) extending upwardly from the upper end of the handle shaft, the cylindrical collar having two vertical channels (20) diametrically opposed to each other, the cylindrical collar having an open top (26) with a cylindrical configuration;

a brush head (36) formed of a plurality of elongated bristle fibers (34), the bristle fibers having lower ends (104) secured in the open top of the cylindrical collar, the bristle fibers having free upper ends (106), the bristle fibers having intermediate extents (98);

a ferrule assembly (22) axially reciprocable upon the cylindrical collar (16) between an operative upper position (V1) and a cleaning lower position (V2), the ferrule assembly formed of an inner coupler (50) and an outer coupler (48), the inner coupler being in sliding contact with the cylindrical collar, the outer coupler being in contact with the inner coupler for sliding therewith, the ferrule assembly having a lower end (24) and an upper end (26), the upper end being of a reduced circumference for sliding contact with the intermediate extents of the bristle fibers whereby when the lower end of the ferrule assembly is adjacent to the lower end of the cylindrical collar the bristle fibers are loosely extended for cleaning, and whereby when the lower end of the ferrule assembly is adjacent to the upper end of the cylindrical collar the bristle fibers are held tightly for application of cosmetics;

the outer coupler being formed with circumferential gripping projections (30);

the inner coupler including interiorly extending tabs (78) reciprocable within the vertical channels in the cylindrical collar;

the inner coupler and the outer coupler having oval shaped upper openings (80) (82);

the inner coupler and the outer coupler laterally rotating with the oval shaped upper openings that hold the elongated bristles fibers when the openings are aligned (L2) and then adjusted laterally reducing an uppermost opening diameter (84) of the ferrule assembly which thereby adjusts the formed brush head application shape; and a vibration assembly positioned within the handle, the vibration assembly including a rotatable counterbalance weight (228), a motor (224) for rotating the counterbalance weight, and a source of electrical potential (220) for the motor, the vibration assembly adapted to vibrate the bristle fibers to increase the efficiency of the brush system during cosmetic product application.

* * * * *